US011813498B2

(12) United States Patent
Brink

(10) Patent No.: US 11,813,498 B2
(45) Date of Patent: Nov. 14, 2023

(54) TORQUE PULL-UP BAR ASSEMBLY

(71) Applicant: Brian Brink, Ames, IA (US)

(72) Inventor: Brian Brink, Ames, IA (US)

( * ) Notice: Subject to any disclaimer, the term of this patent is extended or adjusted under 35 U.S.C. 154(b) by 44 days.

(21) Appl. No.: 17/380,159

(22) Filed: Jul. 20, 2021

(65) Prior Publication Data

US 2022/0023715 A1 Jan. 27, 2022

Related U.S. Application Data

(60) Provisional application No. 63/055,135, filed on Jul. 22, 2020.

(51) Int. Cl.

| | |
|---|---|
| ***A63B 23/12*** | (2006.01) |
| ***A63B 23/035*** | (2006.01) |
| ***A63B 21/02*** | (2006.01) |
| ***A63B 21/16*** | (2006.01) |
| ***A63B 1/00*** | (2006.01) |

(52) U.S. Cl.

CPC ..... *A63B 23/1218* (2013.01); *A63B 1/00* (2013.01); *A63B 21/028* (2013.01); *A63B 21/16* (2013.01); *A63B 23/03525* (2013.01)

(58) Field of Classification Search

CPC .. A63B 1/00; A63B 1/005; A63B 3/00; A63B 21/00047; A63B 21/00185; A63B 21/00189; A63B 21/028; A63B 21/0407; A63B 21/0414; A63B 21/0421; A63B 21/0435; A63B 21/068; A63B 21/1618; A63B 21/1627; A63B 21/1645; A63B 21/1681; A63B 21/169; A63B 21/4047; A63B 21/4049; A63B 23/03508; A63B 23/03516; A63B 23/03525; A63B 23/03583; A63B 23/12; A63B 23/1209; A63B 23/1218; A63B 23/1227; A63B 23/1281

See application file for complete search history.

(56) References Cited

U.S. PATENT DOCUMENTS

| | | | | |
|---|---|---|---|---|
| 3,738,650 | A * | 6/1973 | Ossenkop | A63B 21/1627 248/265 |
| 5,180,350 | A * | 1/1993 | Thomas | A63B 1/00 482/40 |
| 5,709,630 | A * | 1/1998 | Froelich, Sr. | A63B 21/015 482/44 |
| 6,019,704 | A * | 2/2000 | Morgan | A63B 23/14 482/99 |
| 7,819,784 | B1 * | 10/2010 | Caswell | A63B 21/4015 482/904 |
| 8,047,972 | B1 * | 11/2011 | Dean | A63B 1/005 482/104 |
| 9,427,612 | B1 * | 8/2016 | Swanson | A63B 21/16 |

(Continued)

*Primary Examiner* — Sundhara M Ganesan
*Assistant Examiner* — Zachary T Moore
(74) *Attorney, Agent, or Firm* — ZarleyConley PLC

(57) ABSTRACT

The disclosure provided herein is directed to a torque pull-up bar having a torque assembly positioned over a pull-up bar that is configured to selectively limit the rotation of a pull-up bar between a static position and freewheeling. In a strong resistance configuration and a weak configuration, the pull-up bar is capable of a limited rotation due to a resistance member that is biased to return to a natural state. Through selective engagement of the resistance member with the pull-up bar, the degree of rotation is modified.

20 Claims, 6 Drawing Sheets

(56) References Cited

U.S. PATENT DOCUMENTS

| | | | | |
|---|---|---|---|---|
| 9,949,588 | B1 * | 4/2018 | Stine | A47K 3/38 |
| 11,439,859 | B2 * | 9/2022 | Shangguan | A63B 23/1218 |
| 2006/0166797 | A1 * | 7/2006 | Hamer | A63B 21/4049 482/121 |
| 2009/0233730 | A1 * | 9/2009 | Doerr | A63B 53/007 473/299 |
| 2011/0092346 | A1 * | 4/2011 | Wakuda | A63B 21/023 482/121 |
| 2012/0094812 | A1 * | 4/2012 | Smiley | A63B 21/05 482/128 |
| 2012/0129658 | A1 * | 5/2012 | Hunt | A63B 23/1218 482/38 |
| 2014/0323275 | A1 * | 10/2014 | Moses, II | A63B 21/4043 482/40 |
| 2016/0193494 | A1 * | 7/2016 | Roepke | A63B 21/0728 482/107 |
| 2017/0021223 | A1 * | 1/2017 | Ramsey | A63B 21/026 |
| 2018/0001132 | A1 * | 1/2018 | Brown, Jr. | A63B 21/0728 |
| 2020/0261765 | A1 * | 8/2020 | Jones | A63B 22/0005 |
| 2020/0398102 | A1 * | 12/2020 | Lindsay | A63B 21/00181 |

* cited by examiner

TORQUE PULL-UP BAR ASSEMBLY

CROSS REFERENCE TO RELATED APPLICATION

This application claims the benefit of U.S. Provisional Application Ser. No. 63/055,135 filed Jul. 22, 2020, the contents of this application is hereby incorporated by reference in their entirety.

BACKGROUND OF THE INVENTION

This disclosure generally relates to a pull-up bar assembly. More specifically, the disclosure relates to a torque pull-up bar assembly.

Pull-up bars are well known in the art given their widespread use in athletic training and their prominent role in CrossFit training and competition where pull-up bars are used for a variety of movements including a basic pull-up, butterfly pull-up, muscle ups, and toes-to-bar. While useful, pull-up bars comprise a static configuration where a bar or shaft extends to and between two surfaces in a fixed position, which causes injury to athletes. More particularly, during use and especially during maneuvers such as a butterfly pullup, the human hand rotates in a downward rotation in relation to the bar and a forward rotation in relation to the individual against the pull-up bar due to the body's movement (commonly referred to as a kip) and the static nature of the pull-up bar causes the hand to rub against the exterior of the pull-up bar. The hands also rub on the pull-up bar as the movement is completed and the hands rotate in an upward rotation in relation to the bar and a rearward rotation in relation to the individual. This rubbing that occurs continuously and repeatedly causes the hand to form blisters or the skin to tear, especially when the volume of repetitions are high.

Another detriment to conventional pull-up bars is the difficulty in maintaining grip. As stated, the hand rotates out of position during the movement of a pull-up and the like and after a number of repetitions are completed the athlete must re-grip the bar. When the pull-up bar is re-gripped, the athlete must alter their movement to allow for the momentary release of the bar to position the hand in the desired arrangement with the pull-up bar. As a result of re-gripping, the athlete's momentum diminishes, their rhythm is disrupted, and energy is expended on the act of re-gripping rather than completing the desired movement. This is particularly troublesome in competitions where a large predefined number of repetitions must be completed in order to progress. Additionally, for athletes outside of competition, the need to re-grip diminishes the number of repetitions that are possible had the athlete not re-gripped.

One modification that has been undertaken is pull-up bars that are freewheeling and thus rotate freely during use. The use of freewheeling pull-up bars has increased in popularity recently due to their novelty and the difficulty they present in maintaining a grip on the pull-up bar as it rotates. Accordingly, the use of freewheeling pull-up bars are primarily used to see how long an individual can hold onto the pull-up bar before they are no longer able to re-grip the pull-up bar and fall away. The demand that freewheeling pull-up bars have on an individual's grip lends the use of such pull-ups bars to increase grip strength. Use of freewheeling pull-up bars for such maneuvers as a basic pull-up, muscle up, toe-to-bar, etc. is impractical at best and dangerous at worst.

Another solution to the problems posed by conventional pull-up bars is the use of a pair of hand grips. Each hand grip comprises a protective layer of material that attaches to the athlete's hand in a similar manner as a glove, e.g., a Velcro band connects to one end of the material and removably wraps around the athlete's wrist and one or more holes in the opposing end of the material receives one or more of the athlete's fingers. While useful, hand grips present their own problems. Most prominently, the use of hand grips is difficult during competitions, such as those in CrossFit, that require transitioning between a pull-up maneuver to a lift and/or carry maneuver with the latter being inhibited by hand grips. As a result, the athlete commonly must remove the hand grips or rotate them about their wrist and out of the way of their palm. Once the athlete must return to the pull-up bar, the hand grips must be transitioned back for use. This process, while relatively quick, is problematic in competition where time is a critical factor. Additionally, hand grips are subject to wear and being lost, which significantly increases the cost of an exercise that is typically viewed as being incredibly low cost.

Thus it is a primary aspect of this disclosure to provide a torque pull-up bar assembly that improves upon the art.

Another aspect of this disclosure is to provide a torque pull-up bar assembly that reduces hand slippage and improves the duration of a one's natural grip.

Yet another aspect of this disclosure is to provide a torque pull-up bar assembly that reduces or obviates the need for use of hand grips.

Another aspect of this disclosure is to provide a torque pull-up bar assembly that reduces or obviates the occurrence of hand blisters or skin tearing.

Yet another aspect of this disclosure is to provide a torque pull-up bar assembly that reduces the need to re-grip.

Another aspect of this disclosure is to provide a torque pull-up bar assembly that is configured to provide a static pull-up bar, a torque pull-up bar, and a freewheeling pull-up bar in a single assembly.

Yet another aspect of this disclosure is to provide a torque pull-up bar assembly that is cost effective, durable, and easy to use.

These and other aspects, features, and advantages of the invention will become apparent from the specification and claims.

SUMMARY OF THE INVENTION

The disclosure provides various aspects of a torque pull-up bar assembly. In one aspect of the disclosure, broadly described herein, a torque assembly provides selective and limited rotation and "spring back" to a natural or neutral position of a pull-up bar during the natural movement of an individual completes an exercise as described herein. In another aspect, the selective configuration of the torque assembly provides a static rotation resistance, an initial or strong rotation resistance, a weak rotation resistance, or a freewheeling rotation resistance. By providing a variety of rotation resistances, the torque pull-up bar assembly allows the pull-up bar to rotate and return to a natural or neutral position of the torque assembly with the natural transition in grip an individual has when using a pull-up bar without inhibiting grip, which is commonly attributed with freewheeling pull-up bars. As a result of the pull-up bar's limited movement and "spring back", the hands of an individual do not rub against the pull-bar in the way the hands would were the pull-up bar held in a static position. In addition to preventing unnecessary wear on the hands, the limited rotation provided by the present invention enhances the duration an individual can go without regripping the pull-up bar.

In one aspect, the torque pull-up bar assembly comprises a mount assembly that provides for mounting the torque pull-up bar assembly to a variety of surfaces. In some aspects, the mount assembly provides for removal of the pull-up bar from the mounting assembly, including by way of passage through cut-out positioned on a first cradle and a second cradle of the mount assembly. In other aspects, a cradle collar that has a clam-shell configuration is provided to retain the pull-bar within the mount assembly. Positioned within each of the cradle collars are rotation members, such as needle bearings, that allow the pull-up bar to rotate freely within the cradle collars as well as the first cradle and second cradle.

In other aspects, the torque assembly has a first bar collar and a second bar collar that are connected directly or indirectly to the pull-up bar. A first coupling is received over the first bar collar and the cradle collar of the first cradle and a second coupling is received over the second bar collar and the cradle collar of the second cradle. Clamp members are positioned over each respective collar and selectively tightened or engaged to provide the various forms of rotation resistance disclosed herein. For instance, in one aspect, each and every clamp members is tightened and in doing so the first coupling engages with the first bar collar and the second coupling engages the second bar collar thereby resisting but not prohibiting rotation of the pull-up bar during use. To further reduce but not eliminate the rotation resistance to pull-bar's rotation, the clamp member over the first bar collar is released so that the first coupling does not provide rotation resistance against rotation—notably, the rotation member within the cradle collar attached to the first cradle prevents the first coupling from acting on the pull-up bar. To provide freewheeling, the clamps over both the first bar collar and the second bar collar are released.

To prevent rotation of the pull-up bar, a locking mechanism is provided in another aspect of the invention. The locking mechanism in one aspect comprises a pin received through openings in at least one of the cradles and one side of the pull-up bar.

In still other aspects, the mount assembly includes one or more brace to enhance the rigidity and durability of the torque pull-up bar assembly. In some aspects, the brace is in the form of a brace bar that extends between a pair of mount plates of the mount assembly. When the brace bar is present, the brace bar provides for transitioning immediate transition from a pull-up bar having some degree of rotation and another pull-up bar (brace bar) having no rotation and in this way avoids the need for adjustment of the torque assembly when transitioning between the two.

This has outlined, rather broadly, the features, advantages, solutions, and benefits of the disclosure in order that the description that follows may be better understood. Additional features, advantages, solutions, and benefits of the disclosure will be described in the following. It should be appreciated by those skilled in the art that this disclosure may be readily utilized as a basis for modifying or designing other structures and related operations for carrying out the same purposes of the present disclosure. It should also be realized by those skilled in the art that such equivalent constructions and related operation do not depart from the teachings of the disclosure as set forth in the appended claims. The novel features, together with further objects and advantages, will be better understood from the following description when considered in connection with the accompanying Figures. It is to be expressly understood, however, that each of the Figures is provided for the purpose of illustration and description only and is not intended as a definition of the limits of the present disclosure.

DETAILED DESCRIPTION

Figure 1:
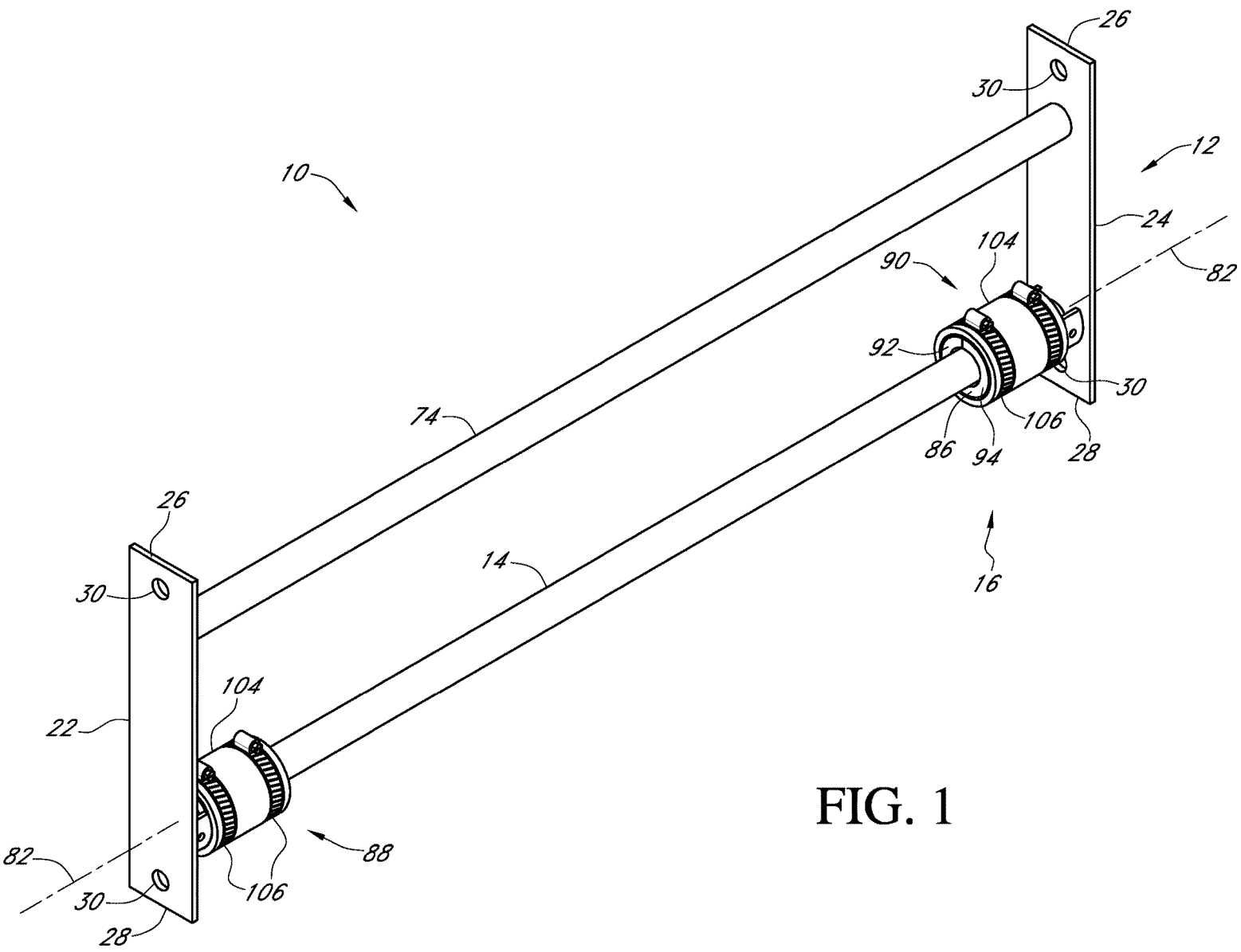
FIG. 1 is a perspective view of a torque pull-up bar assembly according to an aspect of the disclosure.
Figure 2:
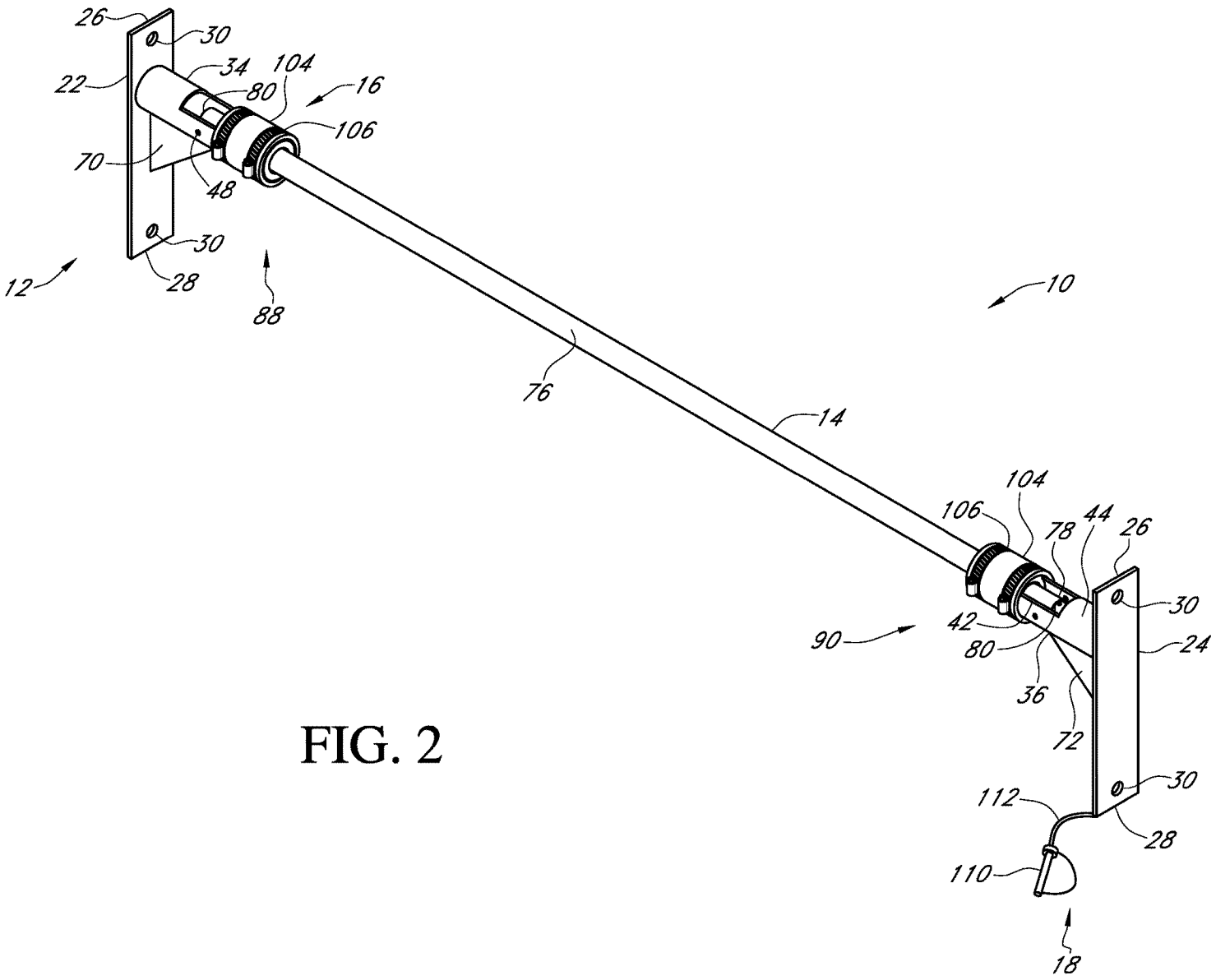
FIG. 2 is a perspective view of a torque pull-up bar assembly according to an aspect of the disclosure.

The disclosure described herein is directed to different aspects of a torque pull-up bar assembly 10. The detailed description set forth below, in connection with the appended drawings, is intended as a description of various configurations and is not intended to represent the only configurations in which the concepts described herein may be practiced. These descriptions include specific details for the purpose of providing a thorough understanding of the various concepts. It will be apparent, however, to those skilled in the art that these concepts may be practiced without these specific details. In some instances, well-known structures and components are shown in block diagram form in order to avoid obscuring such concepts. As described herein, the use of the term "and/or" is intended to represent an "inclusive OR", and the use of the term "or" is intended to represent an "exclusive OR".

The disclosure is described herein with reference to certain aspects, iterations, embodiments, and examples but it is understood that the disclosure can be embodied in many different forms and should not be construed as limited to the aspects set forth herein.

Although the terms first, second, etc. may be used herein to describe various elements or components, these elements or components should not be limited by these terms. These terms are only used to distinguish one element or component from another. Hence, a first element discussed herein could be termed a second element without departing from the teachings of the present application. It is understood that actual systems or fixtures embodying the disclosure can be arranged in many different ways with many more features and elements beyond what is shown in the drawings. For the same or similar elements or features, the same reference numbers may be used throughout the disclosure.

It is to be understood that when an element or component is referred to as being "on" another element or component, it can be directly on the other element or intervening elements may also be present. Furthermore, relative terms such as "between", "within", "below", and similar terms, may be used herein to describe a relationship of one element or component to another. It is understood that these terms are intended to encompass different orientations of the disclosure in addition to the orientation depicted in the figures.

Aspects of the disclosure may be described herein with reference to illustrations of various exemplary embodiments. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the disclosure unless so expressly stated.

With reference to the Figures aspects of a torque pull-up bar assembly 10 are shown according to the disclosure. The torque pull-up bar assembly 10 comprises a mount assembly 12, a pull-up bar 14, and a torque assembly 16. In some aspects, the torque pull-up bar assembly 10 further comprises a locking assembly 18.

The mount assembly 12 in one aspect of the present invention is configured to mount the torque pull-up bar assembly 10 to a surface 20 such as a pair of studs, an existing weight rack, a door frame, or other similar environment that positions the torque pull-up bar assembly 10 in a raised position such that when an individual uses the toque pull-up bar assembly 10 the individual can readily lift themselves from a ground surface as repetitions of an exercise or movement, e.g., butterfly pull-up. In one aspect, the mount assembly 12 comprises a first mount plate 22 and a second mount plate 24 that are configured to removably and/or fixedly receive the pull-up bar 14—with each having a flat elongated profile in another aspect of the inventive subject matter. In another aspect, the first mount plate 22 and the second mount plate 24 extend between a first or top terminal end 26 and a second or bottom terminal end 28. In some aspects, the first mount plate 22 and the second plate 24 each have one or more mount holes 30. In particular aspects, a first mount hole 30 is positioned adjacent the top terminal end 26 a second mount hole 30 is positioned adjacent the bottom terminal end 28. In other aspects, the mount hole 30 of the first mount plate 22 and the second mount plate 24 are positioned adjacent either the top terminal end 26 of the bottom terminal end 28. A connection member 32 (not shown), in some aspects, is received through each mount hole 30 to secure the first mount plate 22 and the second mount plate 24 to the surface 20. In certain aspects, the connection member 32 is a bolt received through each of the first mount plate 22 and the second mount plate 24 on one side of the surface 20 and a nut received over the bolt on the opposing side of the surface 20.

In yet another aspect, the mount assembly 12 also comprises a first cradle 34 connected to the first mount plate 22 and a second cradle 36 connected to the second mount plate 24, which in some instances of the present invention are fixedly connected such as by way of welding and in other aspects are cylindrical but other shapes are contemplated that achieve the same advantages discussed herein. The first cradle 34 and the second cradle 36 each extend substantially perpendicularly or perpendicularly outward from the respective first mount plate 22 and second plate 24 from a first end 38 and towards each other at a second end 40. The first cradle 34 and the second cradle 36 are configured to receive the pull-up bar 14 such that the pull-bar 14 connects to the mount assembly 12. In some aspects, the first cradle 34 and the second cradle 36 have a cut-out or notch 42 positioned on an upper surface 44 that extends from the second end 40 towards, but not to, the first end 38. In some aspects, the cut-out 42 is sized and shaped to permit the pull-up bar 14 to pass through the first cradle 34 and the second cradle 36 and into an internal diameter 46 of the first cradle 34 and the second cradle 36. In some embodiments, the cut-out 42 is slightly larger than a diameter of the pull-up bar 14 but a diameter of the first cradle 34 and the second cradle 36 is such that the cut-out 42 is less than half of the total circumference of each of the first cradle 34 and the second cradle 36. In this way, the ability to remove the pull-up bar 14 requires some degree of precision that reduces the likelihood that the pull-up bar 14 will accidentally be removed during use. In certain aspects, either the first cradle 34 or the second cradle 36 have a cut-out 42 but not both.

In a further aspect, the first cradle 34 and/or the second cradle 36 have a pair of aligned cradle apertures 48. In some aspects, the pair of aligned cradle apertures 48 are aligned laterally from each other about the first cradle 34 and the second cradle 36 and in other aspects are aligned medially. In a lateral configuration of the pair of aligned cradle apertures 48, the use of the locking assembly 18, discussed further herein, is facilitated due to ergonomics.

In yet another aspect of the mount assembly 12, a cradle collar 50 is connected to each of the first cradle 34 and the second cradle 36 at the second terminal end 28. The cradle collar 50 is configured to receive and retain the pull-up bar 14, while in some instances of the present invention provide selective release of the pull-up bar 14. In some aspects, the cradle collar 50 is a two-piece assembly or construction whereby a first portion 52 of the cradle collar 50 is pivotally connected to a second portion 54 in a clam-shell configuration. In this way, the cradle collar 50 can be opened and closed to receive and remove the pull-up bar 14. In some instances, the cradle collar 50 comprises a pair of cradle collar openings 56 that receive a set screw 58 to secure the first portion 52 of the cradle collar 50 to the second portion 54. In particular aspects, the cradle collar 50 is fixedly attached to a bottom edge 60 of the first cradle 34 and the second cradle 36 such as by way of welding. In such a connection, the cradle collar 50 is capable of opening and closing as discussed herein while still being fixedly connected. In other aspects, the cradle collar 50 is a one-piece monolithic construction with the first cradle 34 and/or the second cradle 36.

In some aspects of the present invention, the cradle collar 50 has an internal diameter 62 that is similar or the same as the internal diameter 46 of the first cradle 34 and the second cradle 36, i.e., a diameter that is larger than a diameter 64 of the pull-up bar 14. In some such aspects, a rotation member 66 is received within the internal diameter 62 of the cradle collar 50, wherein the rotation member 66 is configured facilitate or permit rotation of the pull-up bar 14. In certain aspects, the rotation member 66 is a needle bearing that is received over the pull-up bar 14 and retained inside the cradle collar 50 when cradle collar 50 is closed over the rotation member 66.

In other aspects, the cradle collar 50 is configured to facilitate or permit rotation of the bull-up bar 14 without a separate rotation member 66, such as by way of ultra-high molecular weight (UHMW) plastics that provide a low coefficient of friction. In these latter iterations, the absence of a separate rotation member 66 reduces costs associated with parts and assembly.

In yet another aspect, the mount assembly 12 comprises one or more braces 68 that are configured to provide rigidity to the mount assembly 12 and/or the torque pull-up bar assembly 10 generally. In some aspects, the brace 68 comprises a first brace plate 70 and as second brace plate 72. The first brace plate 70 extends to and between the bottom terminal end 28 of the first mount plate 24 and towards the second end 36 of the first cradle 34. Similarly, the second brace plate 72 extends to and between the bottom terminal end of the second mount plate 26 and towards the second end 36 of the second cradle 36. In some aspects, the first brace plate 70 and the second brace plate 72 have a flat triangular profile. In other aspects, the brace 68 further comprises or solely consists of a brace bar 74 that connects to and between the first mount plate 22 and the second mount plate 24 adjacent the respective top terminal end 26 such that the brace bar 74 is positioned above the first cradle 34 and the second cradle 36 during operation. In some instances of the present invention, the brace bar 74 is fixedly connected to the first mount plate 22 and the second mount plate 24 to provide a static position of the brace bar 74 so that an individual can use the brace bar 74 in a similar fashion as a conventional pull-up bar.

The pull-up bar 14 of the present invention can be of any suitable size, diameter, and shape contemplated by the disclosure, including having an exterior surface 76 that is knurled, textured, or smooth depending on the preference of the individual. In some aspects, the pull-bar 14 has a pair of aligned bar apertures 78 positioned adjacent each of opposing terminal end 80 of the pull-up bar 14 and in such a location as to align with the pair of aligned cradle apertures 48 to permit use of the locking assembly 18 as discussed further herein.

The torque assembly 16 in one aspect of the present invention is configured to permit a limited rotation of the pull-up bar 14 about an axis 82 extending through the opposing terminal ends 80 of the pull-up bar 14 during exercise and be biased to return to a natural state where the pull-up bar 14 would be during non-use. In one particular aspect, the torque assembly 16 is configured to limit rotation of the pull-up bar 14 to approximately 15 degrees of rotation from the natural state and in doing so enhances the grip of the individual by permitting the pull-up bar 14 to rotate with the individual's grip without rotating to such an extent that the individual's grip is impeded by extending beyond the individual's natural grip movement. In still other aspects, the torque assembly 16 is configured to adjustably and selectively modify the resistance to rotation the torque assembly 16 provides to the pull-up bar 14. In some such aspects, the torque assembly 16 is configured to limit rotation of the pull-up bar 14 by modifying the amount of resistance to rotation from an initial, higher, or strong rotation resistance to a lower or weak rotation resistance, such that the rotation resistance is modifiable to account for differences between individuals' weights that would otherwise readily overcome or struggle with the rotation resistance provided. By way of example, the initial or strong rotation resistance provides a 185-pound individual the ability to rotate the pull-up bar 14 approximately 15 degrees but a 115-pound individual would be unable to rotate as far, but at a second or weak rotation resistances provides the 115-pound individual the ability to rotate the pull-up bar 14 approximately 15 degrees during use due to the reduced rotation resistance. In yet other aspects, the torque assembly 16 is configured to adjustably and selectively eliminate rotation resistance the torque assembly 16 provides to the pull-up bar 14 such that the pull-up bar 14 is freewheeling, i.e., the torque assembly 16 is essentially inoperable with respect to limiting the rotation of the pull-up bar 14. In one aspect of the invention, the freewheeling operation of the torque assembly 16 is possible without disassembly and/or removal from the torque pull-up bar assembly 10.

In some aspects, the torque assembly 16 comprises a first bar collar 84, a second bar collar 86, a first coupling 88, and a second coupling 90—additional configurations are contemplated that utilize only a first bar collar 84 and first coupling 88 without the presence of the second bar collar 86 and the second coupling 90. The first bar collar 84 and the second bar collar 86 are connected and/or directly connected to the pull-up bar 14 adjacent the opposing terminal ends 80 of the pull-up bar 14. In some aspects, the first bar collar 84 and the second bar collar 86 each have a two-piece assembly or construction whereby each have a first portion 92 pivotally connected to a second portion 94 in a clam-shell configuration. In this way, the first bar collar 84 and the second bar collar 86 can be opened and closed to receive and remove the pull-up bar 14. In some aspects, each of the first bar collar 84 and the second bar collar 86 further comprise a pair of bar collar openings 96 that receive a set screw 58 to secure the first portion 92 to the second portion 94. Alternatively, the first bar collar 84 and the second bar collar 86 are fixedly connected to the pull-up bar 14, including by one-piece monolithic construction.

In another aspect, the first bar collar 84 and the second bar collar 86 have an internal diameter 98 that is the same or substantially the same as the diameter 64 of the pull-up bar 14 such that the first bar collar 84 and second bar collar 86 do not move when placed about the pull-up bar 14. An external diameter 100 of the first bar collar 84 and the second bar collar 86, in some aspect, is the same or substantially the same as an external diameter 102 of the cradle collar 50 of the first cradle 34 and the second cradle 36.

Figure 3:
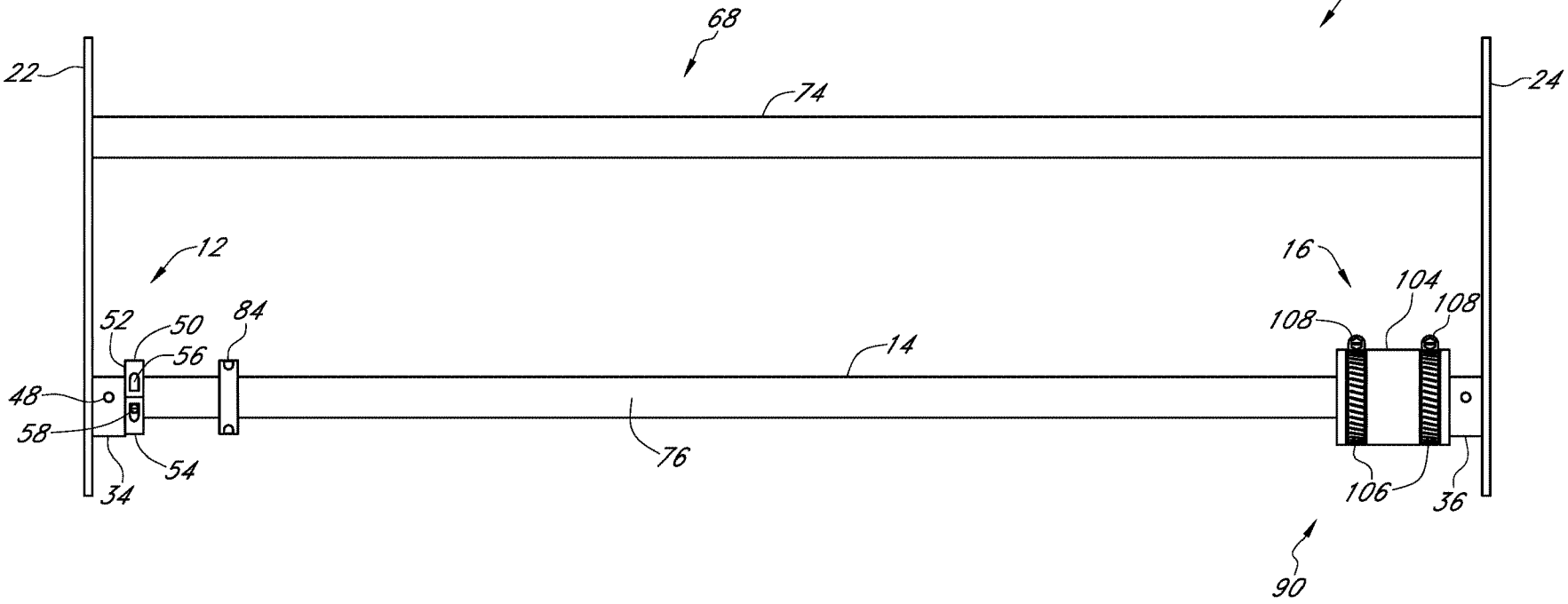
FIG. 3 is a front view of a torque pull-up bar assembly according to an aspect of the disclosure.
Figure 4:
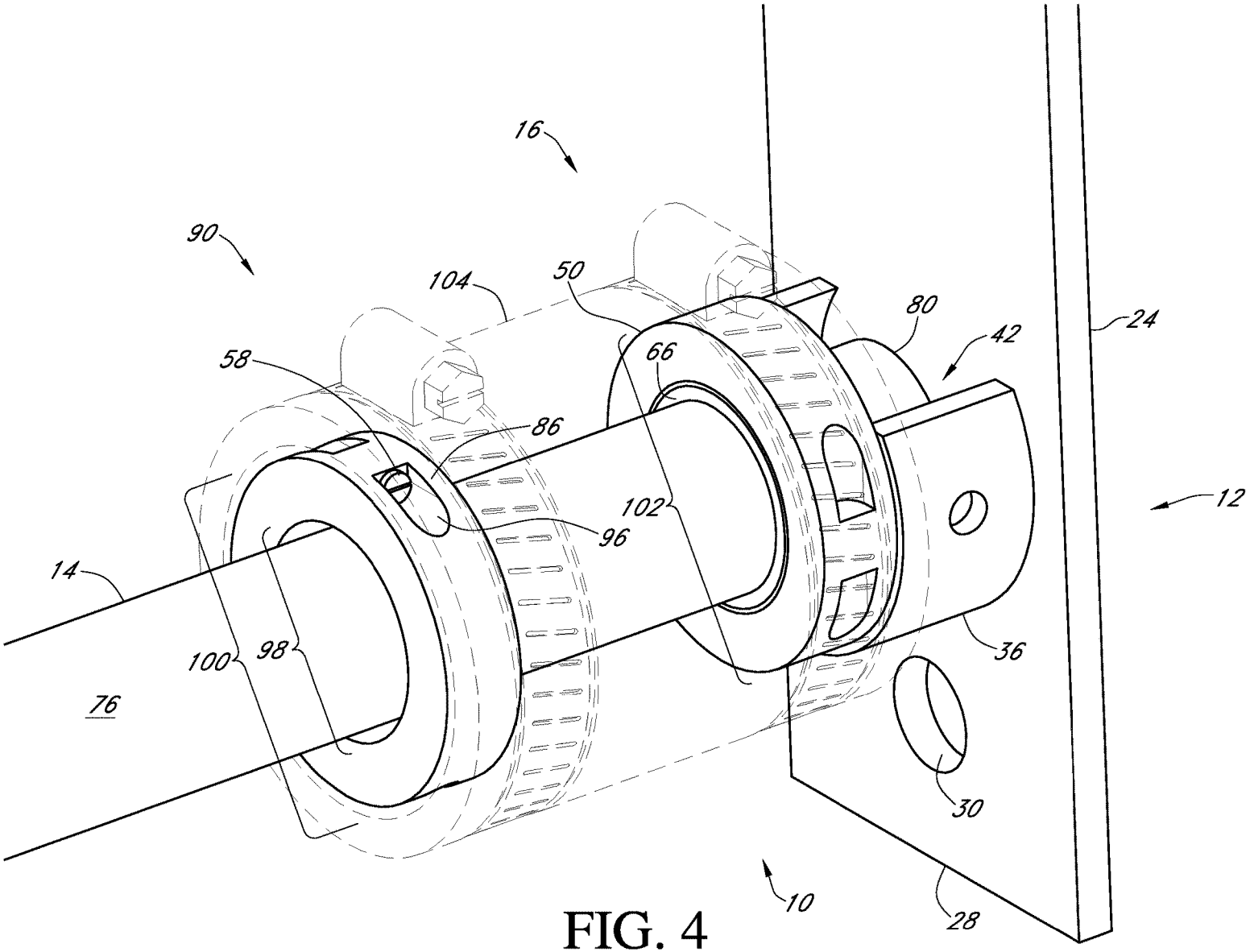
FIG. 4 is a perspective, transparent view of a torque pull-up bar assembly according to an aspect of the disclosure.
Figure 5:
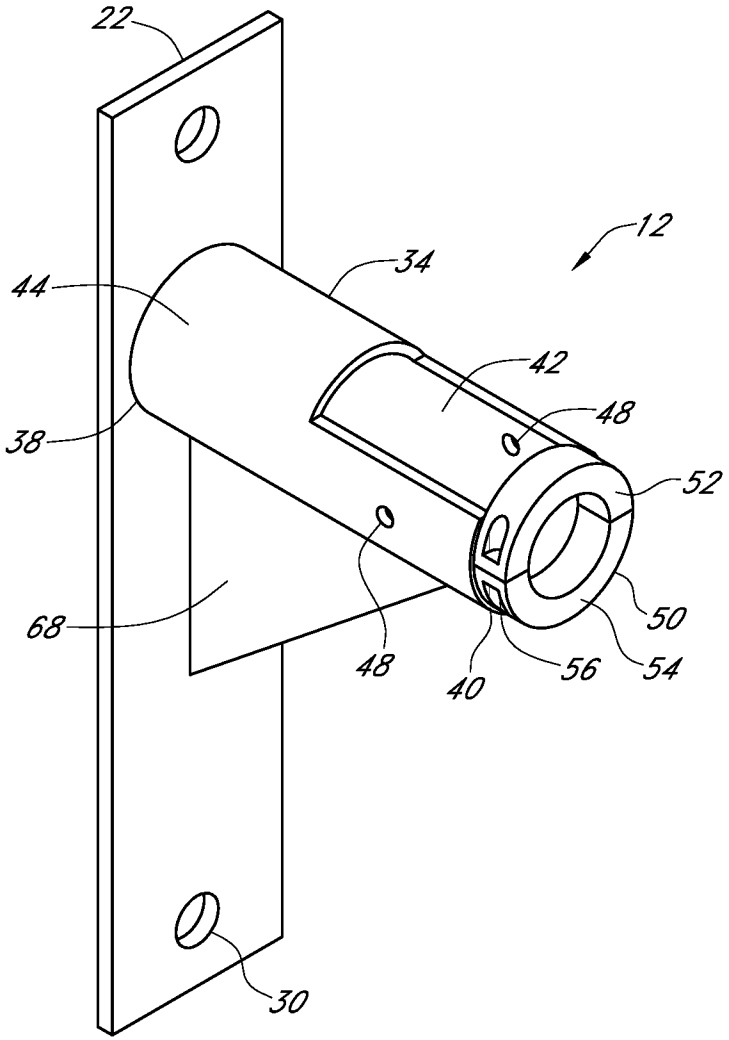
FIG. 5 is a perspective view of a mount assembly of a torque pull-up bar assembly according to an aspect of the disclosure.
Figure 7:
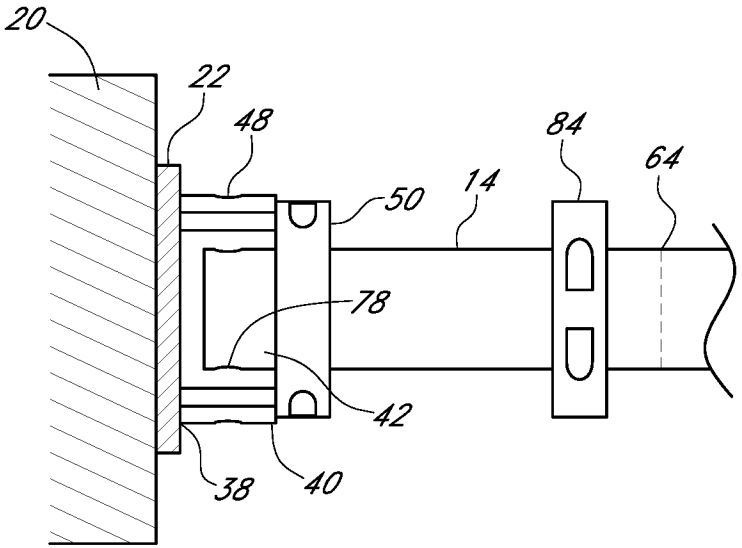
FIG. 7 is a top cross-sectional view of a torque pull-up bar assembly according to an aspect of the disclosure.
Figure 6:
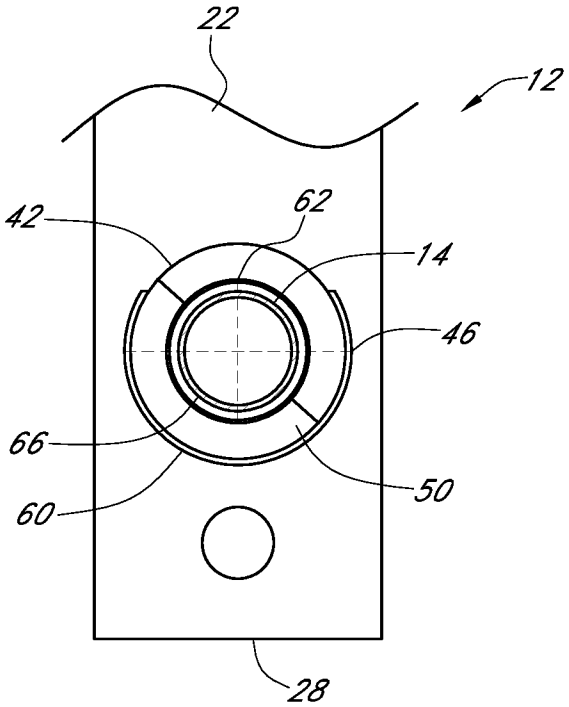
FIG. 6 is a cross-sectional view of a torque pull-up bar assembly according to an aspect of the disclosure.

In yet another aspect, the first coupling 88 and the second coupling 90 each comprise a resistance member 104 that are positioned over the mount assembly 12 and the pull-up bar 14 and selectively and releasably secured with a pair of clamp members 106. As seen in FIGS. 3 and 4, the resistance member 104 of the first coupling 88 is a positioned over the cradle collar 50 of the first cradle 34 and the first bar collar 84. One of the pair of clamp members 106 is positioned around the resistance member 104 in alignment of the cradle collar 50 of the first cradle 34 and the other one of the pair of clamp members 106 is positioned around the resistance member 104 in alignment with the first bar collar 84. In this way, the resistance member 104 is pressed into selective and releasable engagement with the cradle collar 50 of the first cradle 34 and first bar collar 84. Likewise, the resistance member 104 of the second coupling 90 is a positioned over the cradle collar 50 of the second cradle 36 and the second bar collar 86. One clamp member 106 is positioned around the resistance member 104 in alignment of the cradle collar 50 of the second cradle 36 and the other one of the pair of clamp members 106 is positioned around the resistance member 104 in alignment with the second bar collar 86. Hence, the resistance member 104 is pressed into selective and releasable engagement with the cradle collar 50 of the second cradle 36 and second bar collar 86.

As seen in the exemplary illustrations, the resistance member 104 in some embodiments is a rubber tubing or material 104 that provides elastic tension and a strong frictional engagement with the cradle collar 50 and respective bar collar 84 and 86, though other embodiments are contemplated, including the use of torsion springs, dual coil springs, and air shocks. As also shown in the exemplary illustrations, the clamp members 106 in one aspect of the present invention are hose clamps 106 that are releasable by removal of a screw 108 that tightens the hose clamps 106. In other contemplated embodiments, the clamp members 106 are quick clamps and cam clamps, which provide selective engagement without the use of tools.

The locking assembly 18, in one aspect, is configured to prevent the rotation of the pull-up bar 14 regardless of the operation of the torque assembly 16. In some such aspects, the locking assembly 18 comprises a pin 110 such as a locking pin 110 that is received through one of the pair of aligned bar apertures 78 and one of the pair of aligned cradle apertures 48 such that the pin 110 extends through one of the first cradle 34 or second cradle 36 and the pull-up bar 14.

In this way, the pull-up bar 14 is prevented from rotating due to the fixed position of the pin 110. In some aspects, the pin 110 is connected to the torque pull-up assembly 10 by way of a tether 112 to provide quick access and avoidance of misplacing the pin 110. While the pair of aligned bar apertures 78 and the pair of aligned cradle apertures 48 are present on both sides of the torque pull-up bar assembly 10, use of a single pin 110 is contemplated along with two pins 110.

In an exemplary operation using a strong or initial configuration or rotation resistance, all of the clamp members 106 are tightened so resistance member 104 of the first coupling 88 is pressed into engagement with the cradle collar 50 of the first cradle 34 as well as the first bar collar 84 and the second coupling 90 is pressed into engagement with the cradle collar 50 of the second cradle 36 as well as the second bar collar 86. During exercise, the pull-up bar 14 encounters little to no rotation resistance to rotation within the cradle collars 50 due to the rotation member 66 that prevents the resistance member 104 from acting on the pull-up bar 14. However, the engagement of the respective resistance members 104 against the first bar collar 84 and the second bar collar 86 causes the resistance member 104 to act on the pull-up bar 14, e.g., by limiting rotation due to the strength of rubber tubing 104 that acts to return or "spring back" to a natural or neutral state. In particular aspects, the rotational resistance of the resistance member 104 is applied to the first bar collar 84 and the second bar collar 86 as the individual begins a kip and the hands of the individual rotate away from the neutral position of the pull-up bar 14 and the resistance member 104 and as the hands rotate back to their original position as the kip is completed, the resistance member 104 "springs back" to the neutral or natural state. This is repeated during each repetition of the movement.

In an exemplary operation using a weak configuration or rotational resistance, one of the clamp members 106 is disengaged from over either the first bar collar 84 or the second bar collar 86. In this way, the resistance member 104 is no longer pressed into engagement with both the first bar collar 84 and the second bar collar 86, however, the engagement with one of either the first bar collar 84 or the second bar collar 86 provides rotational resistance, albeit lesser than that provided in the strong configuration.

In an exemplary operation using a freewheeling configuration or rotation resistance, the clamp members 106 are disengaged from over both the first bar collar 84 and the second bar collar 86 such that the resistance members 104 do not act in any meaningful way to limit or prevent full rotation of the pull-up bar 14 about the axis 82.

In an exemplary operation using a static configuration or rotation resistance, the pin 110 is placed through one of the pair of aligned bar apertures 78 and one of the pair of aligned cradle apertures 48 such that the pin 110 prevents the pull-up bar 14 from rotating due to the fixed position of the pin 110. Alternatively, in embodiments having a brace bar 74, the individual can simply and quickly transition from the pull-up bar 14, which may be in one of the strong configuration, weak configuration, or the freewheeling configuration without modification to the torque assembly 16. This transition can be facilitated by staggering or offsetting the position of the brace bar 74 from the pull-up bar 14.

Testing of aspects of the torque pull-up bar assembly 10 disclosed herein, a 185 pound individual was able to complete 20 repetitions of a butterfly pull-up without regripping using the strong rotation resistance, whereas a static rotation resistance requires 2 instances of regripping during a 20 repetitions of a butterfly pull-up.

Therefore, a torque pull-up bar assembly 10 has been provided that reduces hand slippage and improves the duration of a one's natural grip, reduces or obviates the need for use of hand grips, reduces or obviates the occurrence of hand blisters or skin tearing, reduces the need to re-grip, is configured to provide a static pull-up bar, a torque pull-up bar, and a freewheeling pull-up bar in a single assembly, is cost effective, durable, and easy to use, and improves upon the art.

From the above discussion and accompanying figures and claims it will be appreciated that the torque pull-up bar 10 offers many advantages over the prior art. Although the present disclosure and its advantages have been described in detail, it should be understood that various changes, substitutions, modifications, and alterations can be made herein without departing from the technology of the disclosure as defined by the appended claims. The scope of the present application is not intended to be limited to the particular configurations of the process, machine, manufacture, composition of matter, means, methods and steps described in the specification only expressly stated otherwise. As one of ordinary skill in the art will readily appreciate from the disclosure, processes, machines, manufacture, compositions of matter, means, methods, or steps, presently existing or later to be developed that perform substantially the same function or achieve substantially the same result as the corresponding configurations described herein may be utilized according to the present disclosure. Accordingly, the appended claims are intended to include within their scope such processes, machines, manufacture, compositions of matter, means, methods, or steps.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein but is to be accorded the widest scope consistent with the principles and novel features disclosed herein.

What is claimed is:

1. A torque pull-up bar assembly comprising:

a mount assembly having a first cradle and a second cradle;

a pull-up bar connected to the mount assembly;

the first cradle and the second cradle each connected to a respective cradle collar;

a torque assembly having a first bar collar and operatively connected to the mount assembly and the pull-up bar, wherein the torque assembly is configured to provide a rotational resistance; and the first bar collar and a second bar collar connected to the pull-up bar;

wherein the torque assembly comprises a first coupling having a resistance member and a pair of clamp members and a second coupling having a resistance member and a pair of clamp members.

2. The assembly of claim 1 wherein the mount assembly comprises a first mount plate having the first cradle and a second mount plate having the second cradle.

3. The assembly of claim 2 wherein the first cradle extends from a first terminal end connected to the first mount plate to a second terminal end, wherein a cut-out on an upper surface of the first cradle extends from the second terminal end towards the first terminal end.

4. The assembly of claim 1 wherein the respective cradle collar of the first cradle and the second cradle each have a two-piece construction comprising a first portion pivotally connected to a second portion in a clam-shell configuration.

5. The assembly of claim 1 further comprising a rotation member received within the first cradle and the second cradle.

6. The assembly of claim 1 wherein the resistance member of the first coupling engages the first bar collar and the respective cradle collar of the first cradle; and the resistance member of the second coupling engages the second bar collar and the respective cradle collar of the second cradle.

7. The assembly of claim 6 wherein one of the pair of clamp members of the first coupling is positioned over the respective cradle collar of the first cradle and the other one of the pair of clamp members of the first coupling is positioned over the first bar collar.

8. The assembly of claim 7 wherein one of the pair of clamp members of the second coupling is positioned over the respective cradle collar of the second cradle and the other one of the pair of clamp members of the second coupling is positioned over the second bar collar.

9. The assembly of claim 8 wherein a strong rotation resistance has the clamp member over the first bar collar and the clamp member over the second bar collar tightened.

10. The assembly of claim 8 wherein the torque assembly is configured to provide a weaker rotation resistance relative to a strong rotation resistance, wherein the weaker resistance has the clamp member over the first bar collar tightened and the clamp member over the second bar collar released.

11. The assembly of claim 8 wherein the torque assembly is configured to provide a freewheeling rotation resistance, wherein the freewheeling rotation resistance has the clamp member over the first bar collar and the clamp member over the second bar collar released.

12. The assembly of claim 1 wherein the resistance member of the first coupling and the second coupling is made of rubber.

13. The assembly of claim 1 wherein the mount assembly comprises a brace bar fixedly connected between a first mount plate and a second mount plate of the mount assembly.

14. The assembly of claim 1 further comprising the first cradle having a pair of aligned cradle apertures, the pull-up bar having a pair of aligned bar apertures, and a pin selectively received through the pair of aligned cradle apertures and the pair of aligned bar apertures; wherein the pin is received through the pair of aligned cradle apertures and the pair of aligned bar apertures a static rotation resistance is provided such that the pull-up bar is prevented from rotating.

15. The assembly of claim 1 wherein the respective cradle collar of the first cradle and the second cradle are rotatably connected to the pull-up bar and the first bar collar is statically connected to pull-up bar.

16. A torque pull-up bar assembly comprising:

a mount assembly having a first cradle and a second cradle;

a cradle collar connected to each of the first cradle and the second cradle;

a pull-up bar connected to the mount assembly;

a torque assembly comprising:

a first bar collar and a second bar collar connected to the pull-up bar;

a first coupling having a resistance member and a second coupling having a resistance member;

wherein the resistance member of the first coupling engages the first bar collar and the cradle collar of the first cradle;

wherein the resistance member of the second coupling engages the second bar collar and the cradle collar of the second cradle; and wherein the torque assembly operatively connected to the mount assembly and the pull-up bar, wherein the torque assembly is configured to provide a rotational resistance.

17. The assembly of claim 16 wherein the mount assembly comprises a brace bar fixedly connected between a first mount plate and a second mount plate of the mount assembly.

18. The assembly of claim 16 further comprising the first cradle having a pair of aligned cradle apertures, the pull-up bar having a pair of aligned bar apertures, and a pin selectively received through the pair of aligned cradle apertures and the pair of aligned bar apertures, wherein the pin is received through the pair of aligned cradle apertures and the pair of aligned bar apertures a static rotation resistance is provided such that the pull-up bar is prevented from rotating.

19. A torque pull-up bar assembly comprising:

a mount assembly having a first cradle and a second cradle;

a pull-up bar connected to the mount assembly;

the first cradle and the second cradle each connected to a respective cradle collar; and a torque assembly having a first bar collar and operatively connected to the mount assembly and the pull-up bar, wherein the torque assembly is configured to provide a rotational resistance;

wherein the mount assembly comprises a first mount plate having the first cradle and a second mount plate having the second cradle.

20. The assembly of claim 19 wherein the first cradle extends from a first terminal end connected to the first mount plate to a second terminal end, wherein a cut-out on an upper surface of the first cradle extends from the second terminal end towards the first terminal end.

* * * * *